US005666701A

United States Patent [19]

Drummond

[11] Patent Number: 5,666,701

[45] Date of Patent: Sep. 16, 1997

[54] SHOULDER-STRAP RETAINER APPARATUS

[76] Inventor: Michaline M. Drummond, 2 Balsam La., Freeport, Me. 04032

[21] Appl. No.: 407,133

[22] Filed: Mar. 20, 1995

[51] Int. Cl.[6] ..... A45F 3/00; A41F 19/00; A44B 18/00

[52] U.S. Cl. ..... 24/302; 224/264; 24/307; 24/178

[58] Field of Search ..... 24/298, 300, 301, 24/302, 307, 178, 3.13; 224/257, 258, 264, 151

[56] References Cited

U.S. PATENT DOCUMENTS

| | | | |
|---|---|---|---|
| D. 325,470 | 4/1992 | Harms | 224/264 X |
| 1,401,227 | 12/1921 | Wyeth | 24/301 X |
| 1,828,196 | 10/1931 | McCann | 24/178 R |
| 2,134,242 | 10/1938 | Wade | 24/302 X |
| 2,608,326 | 8/1952 | Spector . | |
| 3,357,067 | 12/1967 | Baues | 24/178 R X |
| 4,062,065 | 12/1977 | Gardner | 224/264 X |
| 4,811,876 | 3/1989 | Riggi | 224/264 X |
| 4,858,283 | 8/1989 | Takeuchi | 24/178 |
| 4,879,768 | 11/1989 | McClees et al. | 224/264 X |
| 4,911,347 | 3/1990 | Wilhite | 224/264 X |
| 5,042,113 | 8/1991 | Severson et al. | 24/300 X |
| 5,307,966 | 5/1994 | Inaba et al. | 224/264 X |
| 5,307,967 | 5/1994 | Seals | 224/151 X |

FOREIGN PATENT DOCUMENTS

| | | | |
|---|---|---|---|
| 619351 | 3/1949 | United Kingdom | 224/264 |

*Primary Examiner*—Peter M. Cuomo
*Assistant Examiner*—Robert J. Sandy
*Attorney, Agent, or Firm*—Chris A. Caseiro; Thomas L. Bohan

[57] ABSTRACT

A shoulder-strap retainer attachable to a shoulder strap for preventing a shoulder strap from slipping off the user's shoulder. The shoulder strap retainer includes a main retainer body, a first retainer end, and a second retainer end. The first retainer end is axially connected to one end of the main retainer body and includes a first tongue end operatively associated with a first securing means. The second retainer end is axially connected to a second end of the main retainer body and includes a second tongue end operatively associated with a second securing means. The first retainer end is attached to one leg of the shoulder strap and the second retainer end is attached to a second leg of the shoulder strap. The shoulder-strap retainer is used such that the shoulder strap is placed on top of the shoulder while the shoulder-strap retainer is positioned underneath the arm and adjusted to securely fit the shoulder strap to the shoulder.

7 Claims, 3 Drawing Sheets

SHOULDER-STRAP RETAINER APPARATUS

BACKGROUND OF THE INVENTION

1. Field of the Invention

The present invention relates to an apparatus for preventing a shoulder strap attached to a carrying case, a handbag, etc., from slipping off of one's shoulder while in use. In particular, the present invention relates to an apparatus which attaches to a shoulder strap forming a smaller loop in the shoulder strap wherein the smaller loop formed in the shoulder strap is worn over the shoulder. More particularly, the present invention relates to an adjustable belt which is attached to the shoulder strap and is worn under the arm to prevent the shoulder strap from slipping off of the shoulder by drawing the upper portion of the shoulder strap more snugly around the shoulder than it would otherwise be when the shoulder strap of the carrying bag is placed on the shoulder.

2. Description of the Prior Art

A shoulder strap for carrying bags and the like has long been recognized as an important means for easily transporting various weighted objects while leaving the hands free for other purposes. Several problems with the shoulder strap were quickly recognized, however. When the shoulder strap is in use, any movement by the user can cause the strap to slip off of the user's shoulder and, thereby, cause the item carried to fall off. In order to compensate for this natural slippage, people will often walk with their shoulders angled such that the shoulder carrying the strap is lifted higher than the opposite shoulder. Although this posture-distorting compensation does manage to prevent the shoulder strap from slipping off one's shoulder, it is rather uncomfortable when maintained for any length of time. An alternative carrying technique that is sometimes used is to wear the shoulder strap across the chest. That is, with the strap on the shoulder of one arm and the object being carried located under the other arm. Unfortunately, not all shoulder straps are long enough to be used in this way. In addition, the appearance of many garments and outfits is spoiled by having the shoulder strap draped across the chest. Another problem encountered is the cutting effect of the shoulder strap into the user's collar bone when carrying heavy loads.

Prior art devices have addressed these problems in various ways, some by the use of retainer clips fastened to the shoulder area of clothing, while others have used non-slip material directly attached to the shoulder strap and placed between the shoulder and the strap. Still others have used retainer clips coated with an adhesive material so that they may be used for attaching directly to the skin. Some of the non-slip devices incorporated padding in their design in an attempt to prevent not only the slipping problem but also the cutting effect of the shoulder strap posed by heavy loads.

All of the prior art devices, however, have attempted to solve the strap-slipping problem with devices used in conjunction with the shoulder strap and top of the shoulder rather than under the arm. U.S. Pat. No. 4,811,876 (1989, Riggi) teaches a shoulder strap retainer for positionally locating a shoulder strap of a handbag or the like relative to the shoulder of a user. The Riggi device includes a base member coated with an adhesive for removably attaching the retainer to the skin on the shoulder of the user. U.S. Pat. No. 4,062,065 (1977, Gardner) teaches a pin-type, safety shoulder strap holder for attaching directly to the shoulder area of a garment. The Gardner device has a hinged, hook portion to hold the strap of a shoulder bag which disconnects if the strap is suddenly pulled. U.S. Pat. No. 2,608,326 (1950, Spector) teaches a shoulder strap gripper which attaches directly to the shoulder strap of a handbag. The Spector device is a pad made from material having a particularly high coefficient of friction so as to increase the friction between the shoulder strap and the shoulder. The pad is removably attached to the shoulder strap by two securing clips located at each end of the pad.

All prior art devices are limited to use on a particular piece of clothing, on a particular type and width of strap, or are unsightly from a fashion standpoint. Because the prior art devices are either fastened to the clothing permanently or removably by use of adhesives, they have a tendency to damage the clothing, or worse, the skin of the user. The present invention can easily be used on straps of any size and can be used with any type of clothing without the concern of damaging the clothing or the skin.

An additional problem associated with shoulder-carried bags is the relative ease with which someone can remove the bag from one's shoulder. All prior art devices use the object's shoulder strap, which forms a relative large loop over the shoulder, as is. The size of this loop is directly proportional to the ease with which the handbag can be removed from the shoulder and arm of the user. In this regard, the present invention has a distinct advantage over all prior art devices. Because it attaches to the two legs of the shoulder strap, fits under the arm, and thereby forms a much smaller loop over the shoulder, it is more difficult for someone to grab the handbag and to slide it off the shoulder and down the arm of the user.

Therefore, what is needed is a retainer that prevents a shoulder strap from sliding off a user's shoulder when the user moves. What is also needed is a shoulder strap retainer that fits all sizes of shoulder straps. What is further needed is a shoulder strap retainer that is comfortable to use and is not limited to use with specific clothing. Finally, what is needed is a shoulder strap retainer that is attached to the shoulder strap below the arm such that when the retainer is placed under the arm, it creates a secure fit of the shoulder strap to the shoulder of the user.

SUMMARY OF THE INVENTION

The present invention provides a shoulder strap retainer for shoulder straps of handbags, cameras, and the like. It is an object of the present invention to provide a shoulder strap retainer that prevents a shoulder strap from easily sliding off a user's shoulder even when the strap is jostled. It is another object of the present invention to provide a shoulder strap retainer that is comfortable to use and that keeps the strap on the shoulder of the user whether the shoulder is clothed or not. A further object of the present invention is to provide a shoulder strap retainer that is used below the arm such that, when the retainer is either slid up under the arm or attached to the strap directly in place under the arm, it creates a secure fit of the shoulder strap to the shoulder of the user.

The shoulder-strap retainer of the present invention includes a pair of securing means located at opposite ends of a main retainer body. The shoulder-strap retainer connects to each of the two "legs" of a shoulder strap of any size and sets a maximum separation spacing between the two. The main retainer body length may be adjustable so as to permit adjustment of the separation spacing. The securing means used for attaching to the shoulder strap includes, but is not limited to, buckles, snaps, buttons, hook-and-loop fasteners, and the like. It is important to note that the securing means creates a small loop, preferably adjustable, through which the standard shoulder strap freely passes, thus allowing for adjustment to fit. The main retainer body is a belt-like material which may be made of any material including elastic, plastic, or metal. However, it is preferably made from leather or a fabric that closely resembles the handbag or its shoulder strap, thus making the retainer attractive and fashionable.

In use, the shoulder-strap retainer draws the two legs of the shoulder strap together below the user's armpit. As noted above, the shoulder-strap retainer can either be slid up or affixed directly beneath the user's armpit tying the strap legs together essentially tightly around the user's shoulder thereby securing the bag in place. By snugly fitting the shoulder strap around the shoulder, the shoulder-strap retainer frees the hands of the user for other purposes without the fear of the shoulder strap slipping off the shoulder. Furthermore, the snug fit increases the security of the bag in that it reduces the likelihood that someone would be able to easily remove the bag from the user's shoulder. An additional characteristic of the present invention is that one size fits all users because it is the effective length of the two legs of the shoulder strap that gets adjusted around the shoulder, not just the length of the shoulder-strap retainer. This is achieved by providing a retainer that may be affixed to the shoulder-strap legs at any point thereof, either by making the retainer slidable, or by making it removably affixable. The closer the shoulder-strap retainer is to the bag being carded, the greater the effective length of the shoulder strap allowed to surround the shoulder. In that way, people of various shoulder sizes can use a single retainer design.

One particular embodiment of the present invention includes a main retainer belt portion having a buckle and a perforated tongue portion on each end. The perforated tongue portion surrounds one leg of the shoulder strap and forms a tongue loop when passed through one side of the buckle. Next, it passes through the opposite side of the buckle, thereby engaging the buckle's hooking means into one of the perforated holes, and then continues on through a belt loop securing the distal end of the tongue portion. This is repeated with the opposing buckle end of the retainer and the other leg of the shoulder strap.

DETAILED DESCRIPTION OF THE PREFERRED EMBODIMENT

Figure 1:
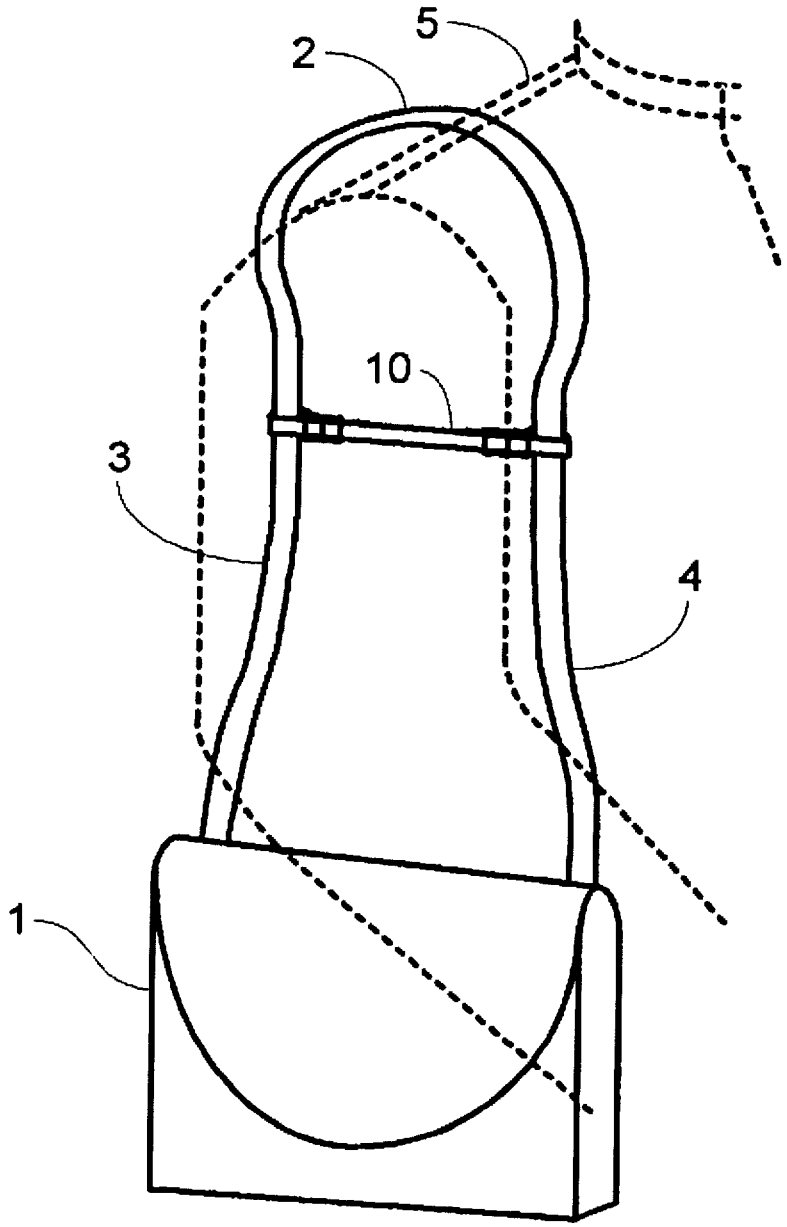
FIG. 1 is a perspective view of the shoulder-strap retainer of the present invention attached to a shoulder strap of a handbag showing it in use on the shoulder of a person.
Figure 2:
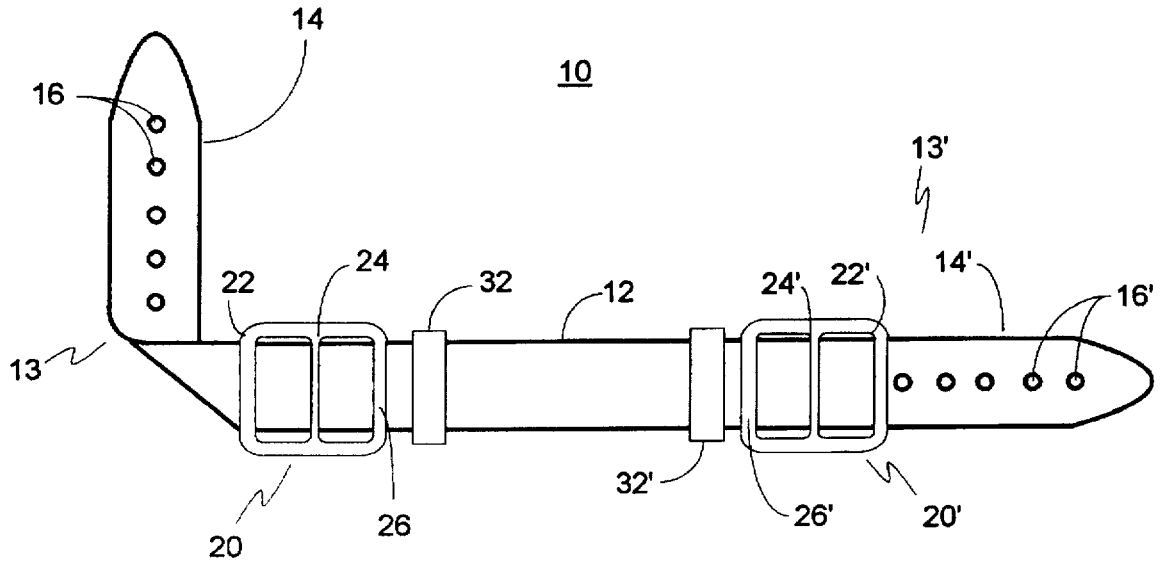
FIG. 2 is a front view of the shoulder-strap retainer of the present invention showing one of the tongue portions folded over.

The preferred embodiment of the present invention is illustrated in FIGS. 1–5. A shoulder-strap retainer 10 is designed to retain a bag 1 having a shoulder strap 2 with a first shoulder-strap leg 3 and a second shoulder-strap leg 4 on a shoulder 5 of a person, as shown in FIG. 1. The shoulder-strap retainer apparatus 10 includes a first retainer end 13, a second retainer end 13', and a main retainer body 12, as shown in FIG. 2. The main retainer body 12 is a belt-like material which may be made of any material including elastic, plastic, or metal; however, it is preferably made from leather or a fabric that closely resembles the handbag or the handbag's strap to which it is attached.

Detailed illustrations of the first retainer end 13 and the second retainer end 13' are shown in FIGS. 2–5. Although the preferred embodiment of the invention is presented as having removably attachable adjustable retainer ends 13 and 13', it is to be understood that the retainer 10 may alternatively be permanently affixed to a shoulder strap 2 so as to be usable with that specific shoulder strap. In the preferred embodiment of the invention, the first retainer end 13 includes a first tongue portion 14, a securing portion 20, and a tongue-portion retainer 32. The securing portion 20 has a first bar 22, a middle bar 24 connected parallel to and at a fixed distance from the first bar 22, a second bar 26 connected parallel to and at a fixed distance from the middle bar 24, and a hook rod 28 pivotally attached on a first rod end **28*a* to the middle bar 24. The first bar 22 has an indentation 22*a* designed to receive a second rod end 28*b* of the hook rod 28. The securing portion 20 is held in place and is attached to the main body retainer 12 by a middle bar loop 12*a* surrounding the middle bar 24 of the securing portion 20. The middle bar loop 12*a* is secured to the main body 12**.

The first tongue portion 14 has a plurality of first holes 16 in a lateral line running down the center of the first tongue portion 14. The plurality of first holes 16 are sized to easily receive the second rod end **28*b* of the hook rod 28 of the securing portion 20 and are equally spaced from each other in a way similar to that of the holes of an ordinary belt. In its closed position, the tongue portion 14 first passes between the first bar 22 and the middle bar 24, forms a first loop 40, then passes over the middle bar 24, under the second bar 26, and finally into tongue-portion retainer 32. The first loop 40 is fixed into position by the engagement of the second rod end 28*b* of the hook rod 28 through one of the plurality of holes 16 in tongue portion 14**.

Second retainer end 13' is configured in a way similar to that of the first retainer end 13. The second retainer end 13' includes a second tongue portion 14', a securing portion 20', and a tongue-portion retainer 32'. The securing portion 20' has a first bar 22', a middle bar 24' connected parallel to and at a fixed distance from the first bar 22', a second bar 26' connected parallel to and at a fixed distance from the middle bar 24', and a hook rod 28' pivotally attached on a first rod end **28*a*' to the middle bar 24'. The first bar 22' has an indentation 22*a*' designed to receive a second rod end 28*b*' of the hook rod 28'. The securing portion 20' is held in place and is attached to the main body retainer 12 by a middle bar loop 12*a*' surrounding the middle bar 24' of the securing portion 20'. The middle bar loop 12*a*' is secured to the main body retainer 12**.

Figure 3:
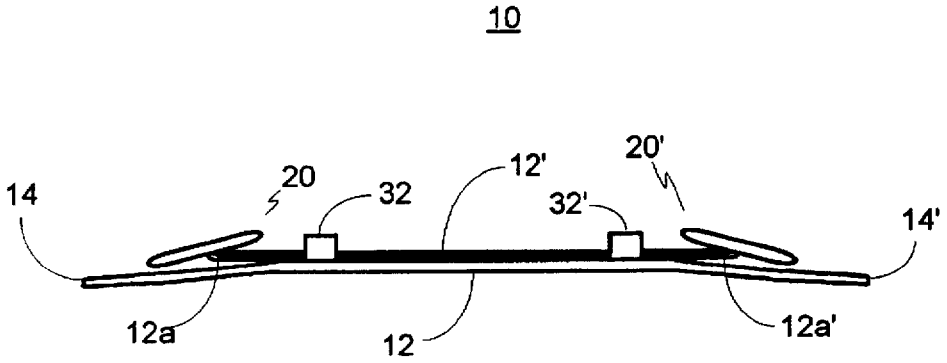
FIG. 3 is a side view of the shoulder-strap retainer of the present invention showing the tongue portions in an open position.
Figure 4:
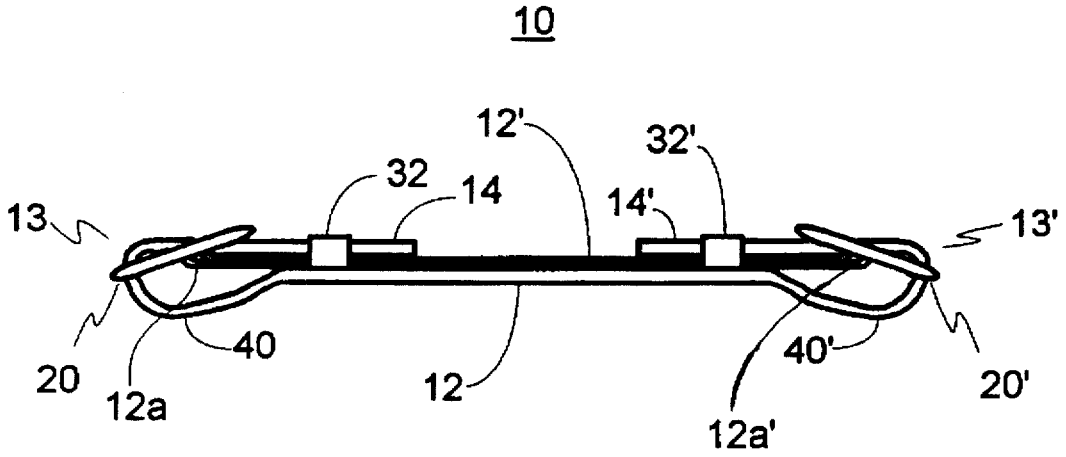
FIG. 4 is a side view of the shoulder-strap retainer of the present invention showing the tongue portions in a closed position forming the tongue loops through which the shoulder strap of a handbag passes.
Figure 5:
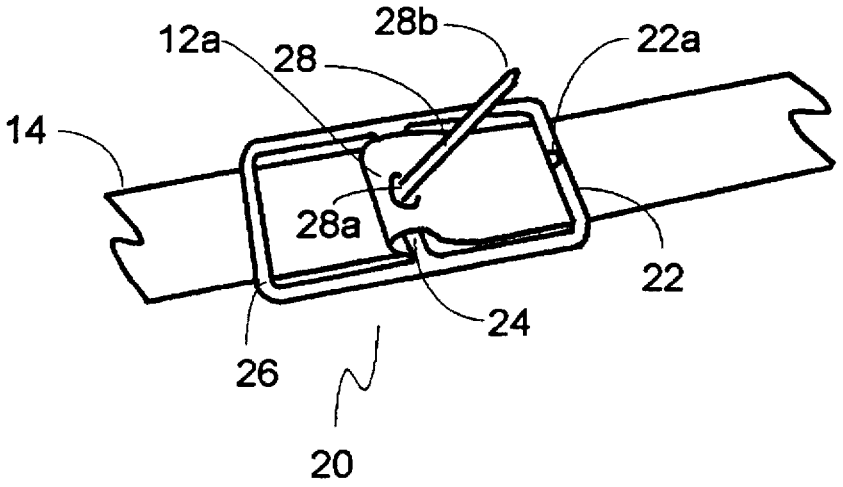
FIG. 5 is an expanded view of the securing means showing the hook rod of the present invention.

As shown in FIGS. 3 and 4, the middle bar loops **12*a* and 12*a*' form a contiguous element 12'. The contiguous element 12' is attached to the main retainer body 12 at their middle areas by any known method for attachment such as by adhesive, sewing, or both. This arrangement results in the layered effect as shown in the cross-section of FIGS. 3 and 4**.

The second tongue portion 14' has a plurality of second holes 16' in a lateral line running down the center of second tongue portion 14'. The plurality of second holes 16' are sized to easily receive the second rod end 28b' of the hook rod 28' of the securing portion 20' and are equally spaced from each other in a way similar that of the holes of an ordinary belt. In its closed position, the second tongue portion 14' first passes between the first bar 22' and the middle bar 24', forms a second loop 40', then passes over the middle bar 24' and under the second bar 26' before finally being inserted into tongue-portion retainer 32'. The second loop 40' is fixed into position by the engagement of the second rod end 28b' of the hook rod 28' through one of the plurality of second holes 16' in second tongue portion 14'.

The shoulder-strap retainer apparatus 10 of the present invention is secured to the shoulder strap 2, as shown in FIG. 1, in the following way. The first tongue portion 14 of first retainer end 13 is passed around the first shoulder-strap leg 3 of the shoulder strap 2 and then between the first bar 22 and the middle bar 24 of securing portion 20 so as to form first loop 40. The first tongue portion 14 is then passed over middle bar 24, under second bar 26, and into tongue-portion retainer 32. A selected one of the plurality of first holes 16 receives hook rod 28 located on the middle bar 24 in an interlocking union, thereby fixing the positioning of the first retainer end 13. First loop 40 is fixed to a particular size diameter around the first shoulder-strap leg 2 because the second rod end 28b of hook rod 28 engages the indentation 22a of first bar 22 and thereby prevents the first tongue portion 14 from moving and, consequently, varying the size of first loop 40.

In like manner, second retainer end 13' is similarly attached to the second shoulder-strap leg 4 of shoulder strap 2. The second tongue portion 14' of second retainer end 13' is passed around the second shoulder-strap leg 4 of shoulder strap 2 and then between the first bar 22' and the middle bar 24' so as to form second loop 40'. The second tongue portion 14' is then passed over the middle bar 24', under the second bar 26', and finally into the tongue-portion retainer 32'. A selected one of the plurality of second holes 16' receives hook rod 28' on the middle bar 24' in an interlocking union, thereby fixing the positioning of the second retainer end 13'. Second loop 40' is fixed to a particular size diameter around the second shoulder-strap leg 4 because the second rod end 28b' of hook rod 28' engages the indentation 22a' of first bar 22' and, thereby, prevents second tongue portion 14' from moving and, consequently, varying the size of second loop 40'.

The first loop 40 and the second loop 40' may be adjusted to allow the shoulder-strap retainer 10 to either hold the first shoulder-strap leg 3 and the second shoulder-strap leg 4 of shoulder strap 2 securely thus making translational movement of the shoulder-strap retainer 10 difficult along shoulder-strap legs 2 and 3, respectively and/or to allow slidable adjustment of shoulder-strap retainer 10 along shoulder strap 2. Unlike any of the prior art which have tried to solve the strap-slipping problem using devices in conjunction with the shoulder strap and the top of the shoulder, the shoulder-strap retainer 10 of the present invention prevents the shoulder strap 2 from falling off one's shoulder by placing the shoulder-strap retainer 10 under the arm and beneath the shoulder. Other embodiments of the present invention include the use of different securing mechanisms serving the same basic function as portions 20 and 20', respectively, such as snaps, buttons, hook-and-loop fasteners such as Velcro(™), and the like.

Although the preferred embodiment of the present invention has been described herein, the above description is merely illustrative. Further modification of the invention herein disclosed will occur to those skilled in the respective arts and all such modifications are deemed to be within the scope of the invention as defined by the appended claims.

What is claimed is:

1. A shoulder strap retainer for preventing a shoulder strap from falling off a shoulder of a shoulder-strap wearer, said shoulder strap retainer being transferrable from one existing shoulder strap to another and being essentially independent of a width of said shoulder strap, said shoulder strap retainer comprising:

a) a main retainer body having a first end and a second end, wherein said main retainer body is structurally inelastic;

b) a contiguous element having a first securing means removably attached to said first end of said main retainer body and a second securing means removably attached to said second end, each of said first securing means and said second securing means located at opposite ends of said contiguous element, said contiguous element being centrally affixed to said main retainer body;

c) a first retainer end that is said first end of said main retainer body and said first securing means of said contiguous element, wherein said first retainer end is a buckle designed to form an adjustable loop removably placeable around a first leg of said shoulder strap; and d) a second retainer end that is said second end of said main retainer body and said second securing means of said contiguous means, wherein said second retainer end is a buckle designed to form an adjustable loop removably placed around a second leg of said shoulder strap, wherein when said first retainer end is placed on said first leg of said shoulder strap and said second retainer end is placed on said second leg of said shoulder strap, said first leg and said second leg are drawn toward one another under said shoulder of said shoulder-strap wearer.

2. The shoulder strap retainer as claimed in claim 1 wherein said first retainer end includes a first tongue end at said first end of said main retainer body.

3. The shoulder strap retainer as claimed in claim 2 wherein said first tongue end is engagable with said first securing means so as to form said adjustable loop of said first retainer end.

4. The shoulder strap retainer as claimed in claim 1 wherein said second retainer end includes a second tongue end and a second securing means affixable to said main retainer body.

5. The shoulder strap retainer as claimed in claim 4 wherein said second tongue end is engageable with said second securing means so as to form said adjustable loop of said second retainer end.

6. A shoulder strap retainer for preventing a shoulder strap from falling off a shoulder of a shoulder-strap wearer, said shoulder strap retainer being transferrable from one existing shoulder strap to another and being essentially independent of a width of said shoulder strap, said shoulder strap retainer comprising:

a) a main retainer body having a first end and a second end, wherein said main retainer body is structurally inelastic;

b) a contiguous element having a first securing means removably attached to said first end of said main retainer body and a second securing means removably attached to said second end, each of said first securing means and said second securing means located at opposite ends of said contiguous element, said contiguous element being centrally affixed to said main retainer body;

c) a first retainer end having a first tongue end operatively associated with said first securing means, said first retainer end being axially connected to one end of said main retainer body, wherein said first retainer end is a buckle designed to form an adjustable loop removably placable around a first leg of said shoulder strap; and d) a second retainer end having a second tongue end operatively associated with said second securing means, said second retainer end being axially connected to a second end of said main retainer body, wherein said second retainer end is a buckle designed to form an adjustable loop removably placeable around a second leg of said shoulder strap, wherein when said first retainer end is placed on said first leg of said shoulder strap and said second retainer end is placed on said second leg of said shoulder strap, said first leg and said second leg are drawn toward one another under said shoulder of said shoulder-strap wearer.

7. The shoulder strap retainer as claimed in claim 6 wherein said shoulder strap retainer is slidably connected to said shoulder strap.

* * * * *